US005082170A

United States Patent [19]

Goss

[11] Patent Number: 5,082,170

[45] Date of Patent: Jan. 21, 1992

[54] MAILBOX SIGNAL FLAG

[76] Inventor: D. Leroy Goss, 9811 Dacono Dr., Richmond, Va. 23228

[21] Appl. No.: 645,145

[22] Filed: Jan. 24, 1991

[51] Int. Cl.[5] ..... B65D 91/00

[52] U.S. Cl. ..... 232/35

[58] Field of Search ..... 232/17, 34, 35, 37

[56] References Cited

U.S. PATENT DOCUMENTS

| | | | |
|---|---|---|---|
| 842,767 | 1/1907 | Clark | 232/34 |
| 2,551,915 | 5/1951 | Turner | 232/34 |
| 2,693,314 | 11/1954 | Hunter | 232/35 |
| 2,939,629 | 6/1960 | Barkdoll | 232/35 |
| 3,301,475 | 1/1967 | Clark | 232/35 |
| 3,482,543 | 12/1969 | Guidos | 232/35 |
| 3,516,383 | 6/1970 | Goodman | 232/35 |
| 3,750,939 | 8/1973 | Halleh | 232/35 |
| 4,113,170 | 9/1978 | Hunsicker | 232/35 |
| 4,147,292 | 4/1979 | Fisher | 232/35 |
| 4,986,467 | 1/1991 | Bibbee | 232/35 X |

*Primary Examiner*—Gary L. Smith
*Assistant Examiner*—Michael J. Milano
*Attorney, Agent, or Firm*—Norman B. Rainer

[57] ABSTRACT

A device is provided for automatically signalling the opening of the door of a conventional mailbox. The device consists of a stationary member that pivotably interacts with a signal member. The stationary member attaches to the mailbox using existing holes intended to accommodate a conventional manually operated mailbox signal flag. A torsion spring housed within the device causes the signal member to be urged to a vertical position when the door of the mailbox is opened.

5 Claims, 3 Drawing Sheets

MAILBOX SIGNAL FLAG

BACKGROUND OF THE INVENTION

1. Field of The Invention

This invention relates to rural mailboxes and more particularly concerns signaling devices which may be attached thereto to indicate the opening of the door of the mailbox as upon mail being placed therein.

2. Description of the Prior Art

Prior art devices which signal the opening of a mailbox usually employ mounting means requiring the drilling of openings in the mailbox and the door thereof. A rigid arm is generally pivotably mounted and retained by some means so that it will swing or otherwise move into visible relation to the mailbox upon being released. The drilling of extra holes in the mailbox requires the use of power tools and often a long extension cord from the house to the mailbox. Furthermore, extra holes in the mailbox serve to further compromise the water resistance ability of the mailbox. The attachment of additional parts to the door of the mailbox may create a hazard to postal workers as protrusions from the mailbox door may catch on clothing or flesh as the door in manipulated from a motor vehicle making frequent stops. In addition, such hardware mounted upon the mailbox door may interfere with the functionality of the mailbox door, especially in cold, icy weather.

Earlier mailbox signal devices include spring type mountings for resiliently holding a rod, as in U.S. Pat. No. 2,433,940, and spring actuated devices for moving a flag portion, as in U.S. Pat. No. 3,338,510. Other mechanically actuated mailbox flags wherein freeing of a pivoted member permits gravity actuated movement are disclosed in U.S. Pat. Nos. 3,294,057 and 3,191,855. Many earlier devices are of complex, multi-component construction and are difficult to install on existing mailboxes. Furthermore, the complicated nature of such devices make them expensive to manufacture, and less durable to outdoor environmental factors. The effects of exposure are manifested in a general loss of reliability over time due to rusting of springs and accumulation of debris in moving parts.

Certain prior art devices, such as disclosed in U.S. Pat. No. 3,482,543, rely upon an adhesive bond to affix the signal device to the mailbox. Poor adhesive surface characteristics, environmental exposure, and the stresses of long term use promote failure of the adhesive bond.

Still other devices, such as disclosed in U.S. Pat. No. 3,750,939, do not lend themselves to use with all types of mailbox support structures. For example, some rural mailboxes are installed on a flat surface such as a horizontal board which supports several mailboxes. Often the mailboxes are narrowly separated. Certain flag devices have appendages which must swing below a plane containing the mailbox's lower extremity. Such swinging movement is obstructed by the above mentioned horizontal supporting surface. Similarly, devices which have members which swing to the side of the mailbox may be restricted by a closely disposed adjacent mailbox. Moreover, such side swinging flags may not be clearly visible from all directions, even when no mailbox is adjacent.

It is accordingly an object of the present invention to provide a mailbox signal device which will automatically alert the homeowner that the mailbox has been opened by a postman.

It is a further object of this invention to provide a mailbox signal device as in the foregoing object which may be retroactively installed on a mailbox simply and without the use of power tools.

It is another object of the present invention to provide a mailbox signal device of the aforesaid nature which is amenable to installation upon mailboxes of standard construction, and capable of functioning regardless of the nature of the mailbox support structure.

It is yet another object of this invention to provide a mailbox signal device of the aforesaid nature which is visible from any direction around the mailbox.

It is still another object of the present invention to provide a mailbox signal device of the aforesaid nature which is of durable construction and reliable in use, having a minimal number of parts, and amenable to low cost manufacture.

These objects and other objects and advantages of the invention will be apparent from the following description.

SUMMARY OF THE INVENTION

The above and other beneficial objects of the present invention are accomplished in accordance with the present invention by a device for automatically signaling the opening of a mailbox, said mailbox having a bottom panel and sidewall structure collectively defining an enclosure having a frontal opening, a door hingedly associated with the bottom panel and having a perimeter flange adapted to seal said frontal opening, and mounting holes in said sidewall structure intended for the bolted securement of conventional manually operable signal means, said device comprised of:

a) a stationary member of integral construction comprised of:

1) a spacer portion having an upper extremity, inner and outer surfaces, and a plurality of mounting apertures communicating between said surfaces and positioned as to be in coaxial alignment with said mounting holes, 2) a flat bracket portion having front and rear extremities and an outer surface that is coplanar with the inner surface of said spacer portion, said rear extremity upwardly disposed from said front extremity, 3) housing means of circular perimeter disposed upon the outer surface of said bracket portion adjacent the rear extremity thereof, and 4) first retaining means fixedly emplaced within said circular perimeter, b) a signal member of integral construction conprised of:

1) a disk portion of generally circular contour configured to pivotably engage said housing means with concomitant formation of centered axle means, said disk portion having fixedly emplaced second retaining means and limiting means for controlling the extent of rotation allowed by said pivotal engagement, 2) an arm portion radially emergent from said disk portion and terminating in a distal extremity which supports an enlarged rectangular panel portion, and 3) latch means associated with said distal extremity and adapted to engage the perimeter flange of the door of the mailbox, thereby maintaining said arm in horizontal disposition, and c) torsional spring having a plurality of coils wrapped around said axle means, a first extremity tangentially emergent from said coils and held by said first retaining means, and a second extremity tangentially emergent from said coils and held by said second retaining means, said spring maintained in a compressed disposition by said first and second retaining means and thereby forcing said arm to rotate to a vertical position upon release of said latch means from said perimeter flange.

In a preferred embodiment, the stationary and signal members may each be of monolithic structure, fabricated of a thermoplastic resin by way of an injection molding process.

In another preferred embodiment, the spring is constructed from stainless steel and has a strength such as to produce an upward force of between 15 and 90 grams, measured at the distal extremity of said arm portion in its horizontal position.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
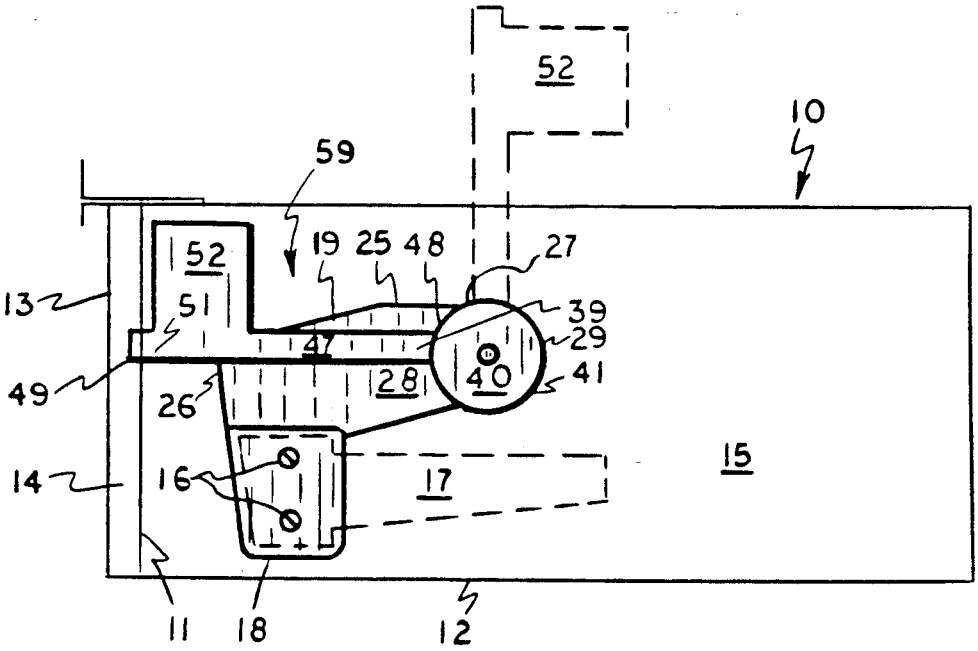
FIG. 1 is a side view of an embodiment of the device of the present invention shown in operative joinder with a mailbox, showing the device in its locked down horizontal state, and in phantom outline in its released, vertical state.
Figure 3:
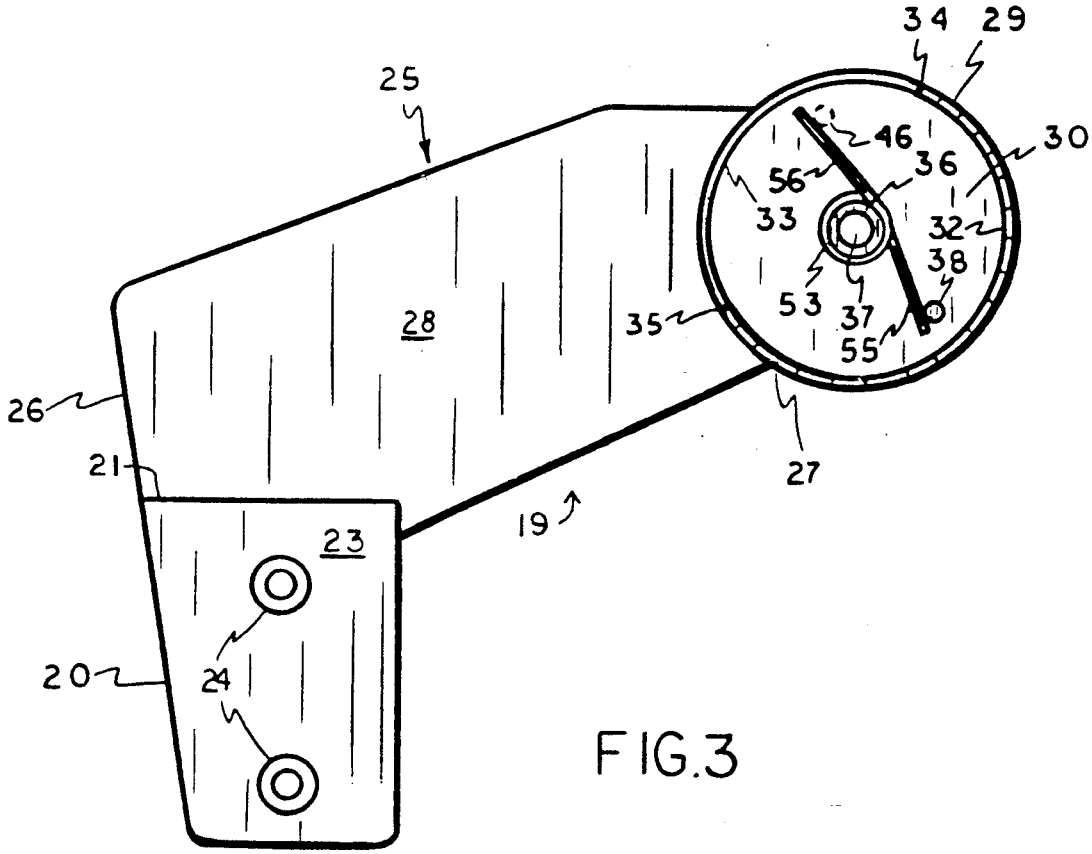
FIG. 3 is a side view of the stationary member of the embodiment of FIG. 1, taken upon the line 3—3 of FIG. 2.
Figure 2:
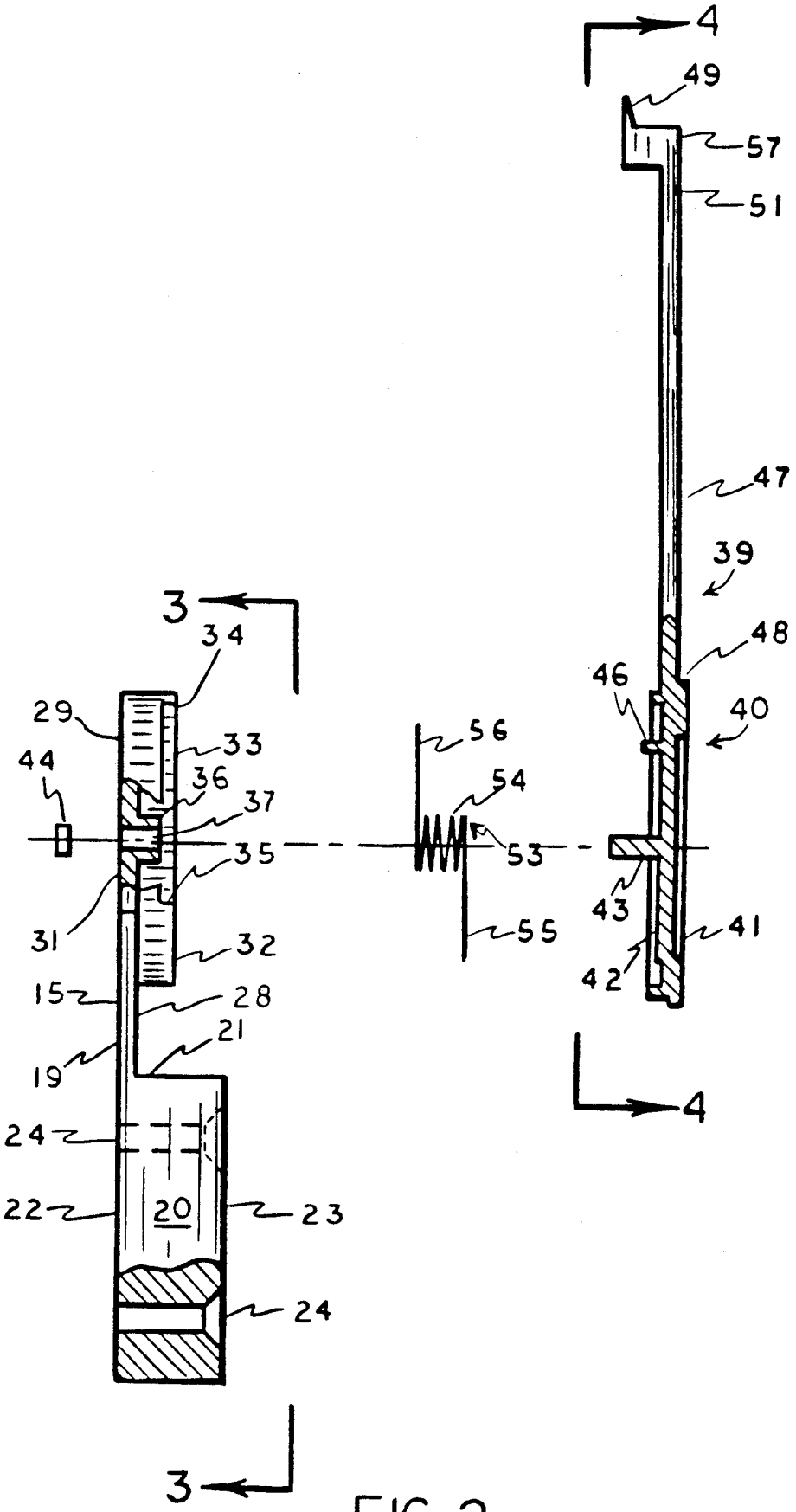
FIG. 2 is an exploded front view of the embodiment of FIG. 1, shown in its vertical state and partly in section.
Figure 4:
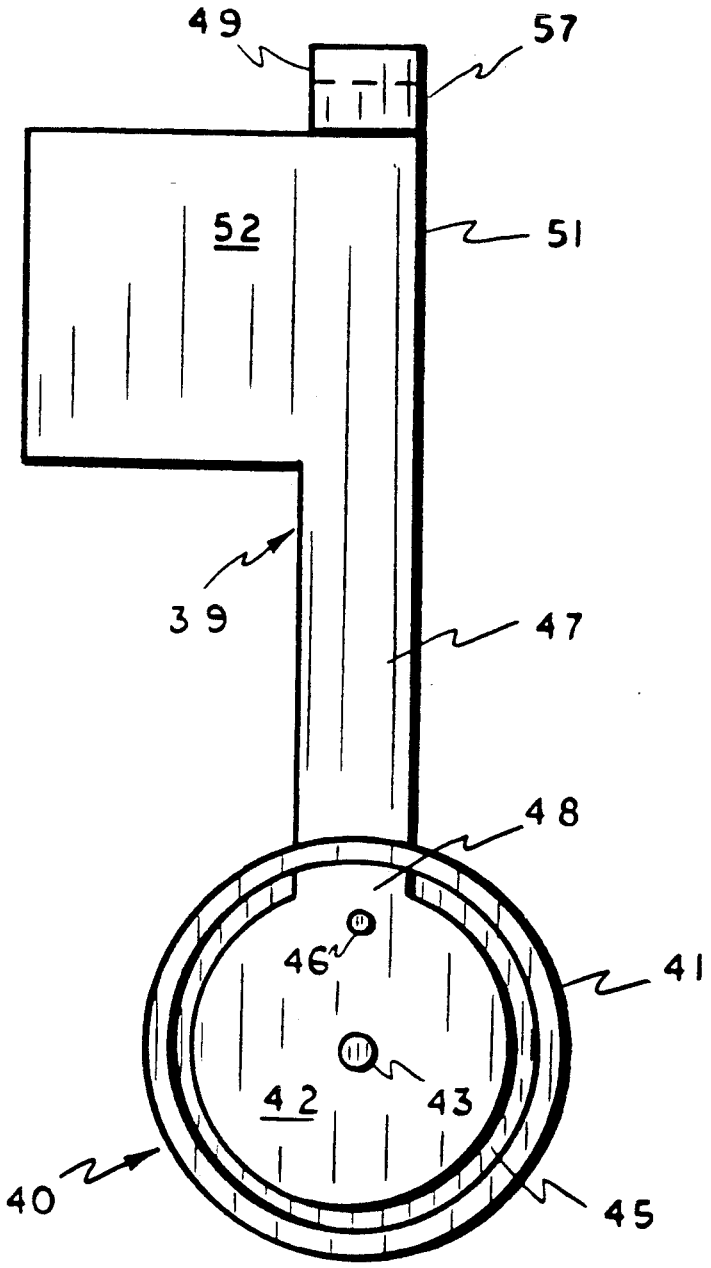
FIG. 4 is a side view of the signal means of the embodiment of FIG. 1, taken upon the line 4—4 of FIG. 2.

Referring to FIGS. 1-4, an embodiment of the mailbox signal device 59 of the present invention is shown in operative joinder with mailbox 10 having sidewall structure 15, bottom panel 12, and frontal opening 11. Front door 13 is hingedly associated with sidewall 15 adjacent said bottom panel. Door 13 has perimeter flange 14 adapted to enclose opening 11 in close conformity therewith. The sidewall structure contains mounting holes 16. Outgoing mail flag 17 of conventional structure is pivotably associated with mounting base 18 which is bolted to the sidewall through mounting holes 16.

The device of this invention is comprised of stationary member 19 fixedly associated with mailbox 10 and signal member 39 pivotably joined to member 19. Stationary member 19 is comprised of spacer means 20 having upper extremity 21, inner and outer surfaces 22 and 23, respectively, and mounting apertures 24 communicating between surfaces 22 and 23. The mounting apertures 24 are spaced as to be coaxial with mounting holes 16. Spacer means 20 may be fixedly interposed between side panel 15 and mounting base 18 of outgoing mail flag 17. Flat bracket portion 25 has front and rear extremities 26 and 27, respectively, and outer surface 28. Bracket portion 25 is essentially a continuous integral and coplanar extension of inner surface 22 of spacer 20. Rear extremity 27 is upwardly disposed from front extremity 26.

Pivot support housing 29 is formed as a continuous integral extension of outer surface 28 of bracket portion 25, and has circular cavity 30 bounded in part by rear wall 31 and annular rim 32. Rim 32 has arcuate recess 33 terminating in upper and lower limiting shoulders, 34 and 35, respectively. Cavity 30 has centered axle means in the form of cylindrical sleeve 36 perpendicularly emergent from rear wall 31 as a continuous integral extension thereof. Sleeve 36 has axially centered bore 37. Cavity 30 has first spring retaining post 38 perpendicularly emergent from rear wall 31.

Signal member 39, of integral construction and pivotally associated with pivot support housing 29, is comprised of rotating disk portion 40 having circumferential extremity 41, interior wall 42 which faces cavity 30, and centered cylindrical shaft 43 perpendicularly emergent from wall 42. Shaft 43 is penetratively journaled to bore 37 and terminates in retaining means 44 associated with the protruding portion of shaft 43 and adapted to maintain said shaft within bore 37. In alternative embodiments, retaining means 44 may instead be a flanged portion of shaft 43, produced after assembly. Disk portion 40 has a substantially annular groove 45 recessed into interior wall 42 in close proximity to circumferential extremity 41, and positioned to embrace annular rim 32. Disk portion 40 has second spring retaining post 46 perpendicularly emergent from interior wall 42.

Arm portion 47 is radially emergent from disk portion 40 and has proximal extremity 48 penetrating circumferential extremity 41, and disposed within groove 45. Proximal extremity 48 is adapted to rotationally abut upper and lower limiting shoulders 34 and 35, respectively, and thereby define a ninety degree arc of rotation. Arm 47 is caused to be disposed vertically when proximal extremity 48 abuts upper limit shoulder 34. Arm 47 is disposed horizontally upon abutment of proximal extremity 48 with lower limit shoulder 35. Arm 47 has distal extremity 51 terminating in enlarged rectangular panel 52.

Latch means in the form of tapered tab 49 is associated with distal extremity 51. A spacer shoulder 57, emergent from panel 52 disposes tab 49 in engaging coplanar relationship with perimeter flange 14, thereby maintaining arm 47 in horizontal disposition. Torsion spring 53, having coils 54 wrapped around sleeve 36, has tangentially emergent first extremity 55 retained by first post 38 and tangentially emergent second extremity 56 retained by second post 46. Spring 53 is maintained in a flexed disposition by first and second retaining posts 38 and 46, respectively, thereby forcing arm 47 to rotate to a vertical position upon release of tab 49 from perimeter flange 14.

The device of this invention may be mounted upon the aforesaid conventional mailbox by removing the conventional mailbox flag, and utilizing the mounting holes that held the mailbox flag. Alternatively, the existing mailbox flag may be left in place, and the present device may be added to the mailbox utilizing the same mounting holes.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A device for automatically signaling the opening of a mailbox, said mailbox having a bottom panel and sidewall structure collectively defining an enclosure having a frontal opening, a door hingedly associated with the bottom panel and having a perimeter flange adapted to seal said frontal opening, and mounting holes in said sidewall structure intended for the bolted securement of conventional manually operable signal means, said device comprised of:

a) a stationary member of integral construction comprised of:

1) a spacer portion having an upper extremity, inner and outer surfaces, and a plurality of mounting apertures communicating between said surfaces and positioned as to be in coaxial alignment with said mounting holes, 2) a flat bracket portion having front and rear extremities and an outer surface that is coplanar with the inner surface of said spacer portion, said rear extremity upwardly disposed from said front extremity, 3) housing means of circular perimeter disposed upon the outer surface of said bracket portion adjacent the rear extremity thereof, and 4) first retaining means fixedly emplaced within said circular perimeter, b) a signal member of integral construction comprised of:

1) a disk portion of generally circular contour configured to pivotably engage said housing means with concomitant formation of centered axle means, said disk portion having fixedly emplaced second retaining means and limiting means for controlling the extent of rotation allowed by said pivotal engagement, 2) an arm portion radially emergent from said disk portion and terminating in a distal extremity which supports an enlarged rectangular panel portion, and 3) latch means associated with said distal extremity and adapted to engage the perimeter flange of the door of the mailbox, thereby maintaining said arm in horizontal disposition, and c) torsional spring means having a plurality of coils wrapped around said axle means, a first extremity tangentially emergent from said coils and held by said first retaining means, and a second extremity tangentially emergent from said coils and held by said second retaining means, said spring maintained in a compressed disposition by said first and second retaining means and thereby forcing said arm to rotate to a vertical position upon release of said latch means from said perimeter flange.

2. The device of claim 1 wherein said limiting means for controlling the extent of rotation of the signal member is a recess within the circular perimeter of said housing means and terminating in upper and lower limiting shoulders.

3. The device of claim 1 wherein the housing means of said stationary member has a centered cylindrical sleeve having an axially centered bore, and said disk has a cylindrical shaft positioned to enter said bore, thereby forming said axle means.

4. The device of claim 1 wherein said latch means is a tapered tab emergent from the distal extremity of said arm portion.

5. The device of claim 2 wherein said limiting shoulders cause said signal member to undergo 90 degrees of circular rotation between said horizontal and vertical states.

* * * * *